United States Patent [19]

Rittinger et al.

[11] Patent Number: 4,894,977

[45] Date of Patent: Jan. 23, 1990

[54] METHOD AND DEVICE FOR THE LENGTH RECTIFICATION OF A FOIL STRIP OF A MATERIAL WHICH SHRINKS DURING COOLING IN MACHINES FOR THE PRODUCTION AND SEPARATION OF PACKAGES

[75] Inventors: Herbert Rittinger; Dieter Janek; Peter Auer; Rudolf Scheffold, all of Laupheim, Fed. Rep. of Germany

[73] Assignee: Josef Uhlmann Maschinenfabrik GbmH & Co. KG, Laupheim, Fed. Rep. of Germany

[21] Appl. No.: 50,881

[22] PCT Filed: Jan. 27, 1987

[86] PCT No.: PCT/DE87/00029

§ 371 Date: May 8, 1987

§ 102(e) Date: May 8, 1987

[30] Foreign Application Priority Data

Jan. 29, 1987 [DE] Fed. Rep. of Germany ..... 3602604

[51] Int. Cl.[4] ..... B65B 57/02; B65B 47/10

[52] U.S. Cl. ..... 53/453; 53/51; 53/559

[58] Field of Search ..... 53/427, 453, 64, 77, 53/51, 559, 140, 141

[56] References Cited

U.S. PATENT DOCUMENTS

| | | | |
|---|---|---|---|
| 3,115,999 | 12/1963 | Wythe | 53/51 X |
| 3,126,431 | 3/1964 | Harder et al. | 53/51 X |
| 3,294,301 | 12/1966 | Richter | 53/51 X |
| 3,427,778 | 2/1969 | McCluskey | 53/51 X |
| 3,555,768 | 1/1971 | Miller | 53/51 X |
| 3,589,095 | 6/1971 | James et al. | 53/51 |
| 3,762,125 | 10/1973 | Prena | 53/51 |
| 3,861,983 | 1/1975 | Harrell | 53/51 X |
| 3,908,331 | 9/1975 | Donnet | 53/51 X |
| 4,018,028 | 4/1977 | Donnet | 53/51 |
| 4,094,127 | 6/1978 | Romagnoli | 53/51 |

FOREIGN PATENT DOCUMENTS

| | | |
|---|---|---|
| 0234307 | 1/1987 | European Pat. Off. . |
| 1232059 | 1/1967 | Fed. Rep. of Germany . |
| 1586127 | 10/1970 | Fed. Rep. of Germany . |
| 2254715 | 12/1982 | Fed. Rep. of Germany . |
| 2206737 | 5/1974 | France . |
| 447924 | 3/1968 | Switzerland . |

*Primary Examiner*—Horace M. Culver
*Attorney, Agent, or Firm*—Herbert Dubno

[57] ABSTRACT

The invention is related to a machine for the production and separation of packages, which packages are formed through deep-drawing from a foil strip transported through a forming station and a separating station of the machine and are then punched out. The foil strip is heated prior to deep-drawing and undergoes a cooling in its travel between the forming station and the separating station. When a transport interruption occurs, the still warm foil strip is stretched between the forming station and the separating station so much, and optionally the size of the elongation is controlled timewise in such a manner that, when the machine is restarted, the foil strip, in spite of the increased cooling which has taken place in the meantime, does maintain the same length as the still warm foil strip at the beginning of the machine interruption. The stretching process prevents the otherwise increased shrinking of the foil strip occurring during the interruption thereby avoiding packaging failures when the machine is restarted after the interruption.

8 Claims, 4 Drawing Sheets

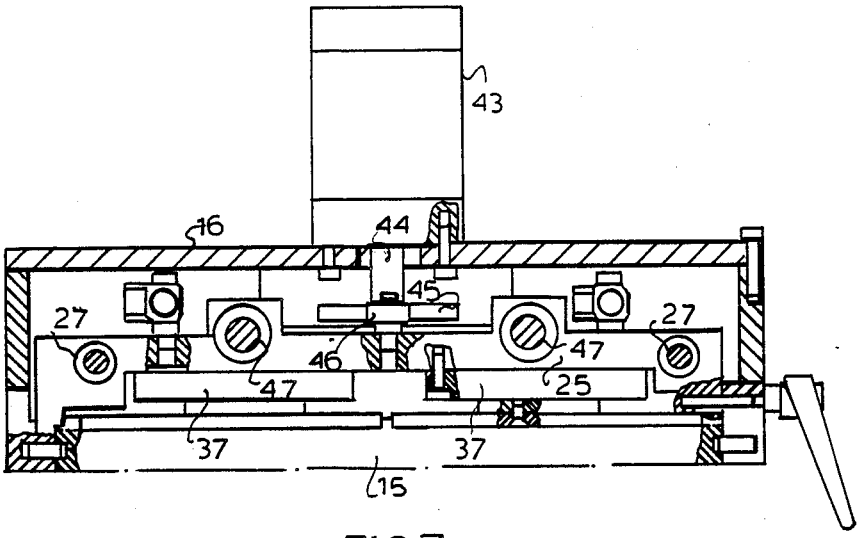
FIG.7
FIG.8
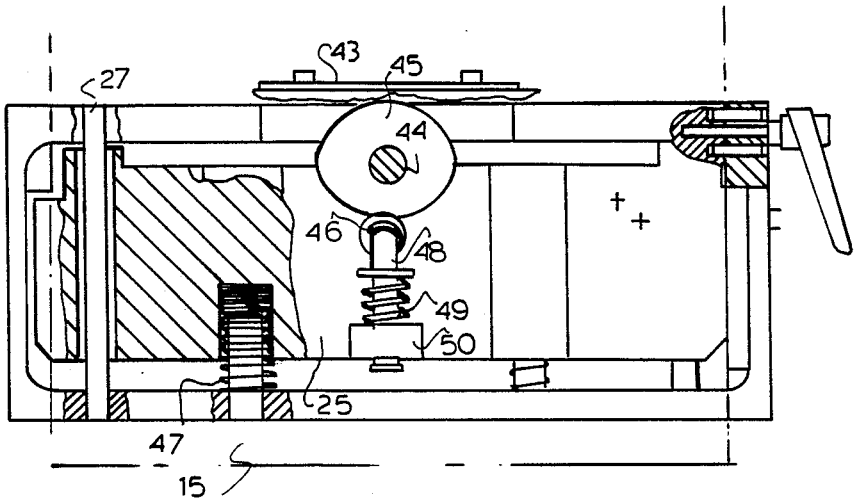

METHOD AND DEVICE FOR THE LENGTH RECTIFICATION OF A FOIL STRIP OF A MATERIAL WHICH SHRINKS DURING COOLING IN MACHINES FOR THE PRODUCTION AND SEPARATION OF PACKAGES

FIELD OF THE INVENTION

The invention relates to a method and a device for length rectification of a shrinkable foil strip such as thermoplastic synthetic material, in machines for the production and separation of packages.

THE RELATED ART

Heated foil strips which are formed through deep drawing cool down and shrink as they move in a longitudinal direction of a package producing/separation machine through a forming station, a further work station (e.g. a sealing station) and a separating station of the machine and, optionally, are cut after filling sealing. Modifications in the package size and the intervals between packages can be automatically absorbed and/or compensated, up to a built-in maximal tolerance range, without impairing the work process.

In such machines, the foil strip, on its way from the forming station to the separating station, experiences a cooling and thereby a longitudinal shrinkage. In the sealing and separating work stations, this shrinkage leads to package intervals and package sizes which remain basically constant in the direction of travel and determines the transport path whereon the foil strip moves in a timed manner through the separating station. This transport path remains constant through the machine cycles. The possibility of minor changes in the package size and intervals between packages, as a result of correspondingly minor changes in the shrinkage characteristics of the foil strip, is taken into consideration by providing a built-in free tolerance play in the following work station, between the package mold and the work tools (e.g. sealing tools). Such length modifications can therefore be easily absorbed or compensated for without impairing the work process during, for instance, the sealing of the package, as long as these modifications remain smaller than the preestablished maximal tolerance resulting from the free tolerance play in the work station. The cooling of the foil strip between the forming station and the separating station is smaller in the case of uninterrupted transport of the foil strip, than in the case of a transport interruption, during which the foil portion between the forming and the separating stations has the opportunity to cool down more or even to reach room temperature. This way, the cooling taking place during the transport interruption is in any case accentuated, leading to a correspondingly stronger longitudinal shrinkage of the strip portion, which is thereby even more shortened. There results in turn even shorter distances between adjacent packages in the travel direction than is the case during uninterrupted operation. This shortening is maintained when the machine is restarted. As a result, a particularly large distance is created between the last package formed before interruption and the first package formed after the machine is restarted. At restart of the machine, when the packages in the strip portion with the higher shrinkage are sealed, increasing packaging failures occur between the package and the sealing tools. These failures correspond to the stronger longitudinal shrinkage occurring during work interruptions and cannot be eliminated. At a path length of approximately two meters between the forming station and the separating station, length differentials can add up to several millimeters. This surpasses by far the aforementioned tolerance range, so that the sealing process can be impaired by the packing failures, the seals can be excessively strained and even the packages can be damaged, until the first package formed after restart of the machine finally reaches the work or sealing station and this way the packing failures come to an end.

In order to reduce the packing failures, it is known to guide the foil strip in a loop between the forming station and the separating station and to vary the length of the loop for the purpose of equalizing the various longitudinal shrinkages of the foil strip. However, in practice considerable problems are encountered in establishing precisely and setting the respectively correct length of the loop. Besides, such a guiding of the foil strip is cumbersome in construction and also expensive.

It is the object of the present invention to develop a method and a device of the aforementioned kind for length rectification of the foil strip in a simple manner and with a precise setting, and that for this purpose the foil strip does not have to be guided in a loop between the forming station and the separating station.

SUMMARY OF THE INVENTION

This object is attained according to the method of the invention by controlled stretching at the beginning of any transport interruption, a strip segment having length L of a warm foil strip. Length L will begin immediately at the forming station, in the direction of travel, and reaching at least past the next work station but no farther than the separating station. This warmed foil strip is securing against displacement in its position at one end and stretched to a longer length L' via traction at its other end. A stretched state will be maintained over the shorter of either the transport interruption time T or only the cooling time T' corresponding to the complete cooling of the strip segment. Proper elongation is so calculated that length difference L' - L at the end of times T or T' is based on the purely elastic elongation of the strip segment which, when it is no longer subject to traction and reverts to its free state, maintains the original length L, and the strip segment contains so many packages arranged one after the other on its length L that the modifications caused by the temporary stretching process in the package size and primarily in the package intervals are respectively only so large as the maximal tolerance permitted by the work process in the following work station.

As a result, according to the invention, the strip segment between the forming station and the separating station is subject to stretching during transport interruptions instead of being permitted to simply cool down at rest. Stretching counteracts the otherwise stronger shrinkage of the strip and insures a constant stretching of the strip segment causing the cooler or even fully cooled strip to have basically the same length at the end of the interruption period as the still warm strip segment had before the onset of the transport interruption. The stretching process according to the invention comprises advantageously tensioning the strip areas lying closer to the forming station and also applying greater tension the warmer the strip. These steps cause the strip segments to be stronger and to thereto corresponding package intervals to be larger, the closer they are located to the forming station, since the strip temperature follows a decreasing course after interruption, starting from the forming station towards the separating station. The hereby caused changes in the package size and intervals between packages remain however within the maximal tolerance range in the work or sealing station so equipped, so that they cannot impair the sealing process in the sealing station and merely lead to packing failures which can be disregarded. When the machine is restarted, or the strip segment is completely cooled down, whichever occurs first, and the stretched strip segment is released, it shrinks then only by the still available elastic elongation and has, when reverted to its state free of longitudinal traction, basically the same length as in the warmer state at the beginning of the interruption, in spite of the cooling which took place in the meantime. The packages following each other in the direction of travel will still have the same intervals, except for the small changes staying well below the tolerance level, as they had prior to the interruption of the machine's operation. As a result, the strip segment is not much different in length after the more intense or perhaps complete cool down, during the interruption, from the state during continuous operation of the machine. Failures in sealing the package are this way avoided in the restarting state of the machine.

Indications as to how much the strip segment has to be stretched and whether and in what way the stretching has to be controlled in time, so that the strip segment maintains its length, in spite of the cooling cannot possibly be predicted. Shrink, stretch and elasticity characteristics of the strip segment cannot be predicted since they depend on too many factors including the type of strip material, its structure, the degree of distortion in the area of the formed packages, temperature along the strip segment, cooling speed, etc. In any case it has to be taken into consideration that the complete cooling of the strip segment to room temperature during machine stoppage occurs approximately within one minute. However, in practice these parameters can be easily established empirically. It is merely necessary to test at the machine, under operational conditions for at most a few interruption periods of maximum one minute, the elongations which would lead to the desired result. Therefore, no difficulties stand in the way of practically adjusting the method according to the invention, from case to case.

A particularly simple way of carrying out the method according to the invention is to insure that the difference in length L' - L of the stretched strip segment is bigger than the reduction due to shrinkage occurring in the strip segment while in its longitudinal-traction free state during times T, T' and that it is so maintained basically constant during those times. This particularly simple manner for rectifying foil length is feasible because the strip segment at higher temperature levels presents higher elastic elongation characteristics than at lower temperatures.

This means that in the case of shorter interruption periods, the elastic elongation component is larger and the plastic elongation component is smaller than in the case of longer interruption periods. With increasing standstill periods, the proportion between the elastic and the plastic elongation component is increasingly reversed, in favor of the latter. As a rule, this simple manner to perform the method is possible only when the standstill time T is always of the same predetermined duration or always longer than the time T' necessary for the complete cooling down to room temperature. In practice, however, the standstill periods of uncertain, sometimes unpredictable duration are much more often encountered. One of the preferred embodiments of the invention consists in controlling the length difference L' - L of the stretched strip segment in such a way during the cooling process taking place in the standstill time T that at each moment this difference is related to the purely elastic elongation of the strip segment considered released at this moment and to the fact that in the immediately subsequent state when it is freed from longitudinal traction, it still preserves its original length L. As a result, the strip segment can then be released at any point in time from its stretched state and it will always resume the initial length L in the state free of longitudinal traction. It is self-understood that the elongation state has to be maintained only until the strip segment has completely cooled down, i.e. no longer than the cooling time T', since after that no shrinkage to be counteracted takes place.

In addition, the method will be performed to insure that the strip segment is secured against displacement at one end between the following work station and the separating station and subjected to traction at its end adjacent to the forming station. Since the strip segment goes through the smallest changes due to shrinkage during machine standstill between the following work station and the separating station, a particularly precise securing in position of the foil strip results, with respect to the work or sealing station.

The invention relates also to a device for carrying out the aforedescribed method in a machine wherein the foil strip successively passes a heating station, a forming station, a further work station making possible the tolerance range for its work process (especially a sealing station), an advance station transporting the foil strip, and a separating station, and wherein the advance station, with respect to the path length between the forming station and the separating station, is arranged close to the latter.

In such a device, the invention consists of the foil strip having a clamping device. The clamping device is arranged in the direction of travel after the heating station, closely before, in or after the forming station, controllable in its grasp on the foil strip, that in the case of a standstill, the clamping device and the advance station grasp the foil strip without slippage and the clamping device or the advance station perform the traction required for the longitudinal elongation of the strip segment. A particularly preferred embodiment is characterized in that the clamping device is an entrainment equipment movable once back-and-forth while the machine is at a standstill, by means of a draw-actuation drive with adjustable path-and/or force characteristics in the case of a transport interruption, the grasp of this equipment on the foil strip can be controlled. Thereby the clamping device grasps the foil strip and holds this without slippage only during standstill time or until it is fully cooled and that the foil strip is secured against longitudinal displacement at the advance station, during transport interruption. The entrainment device effectuates the elongation process of the strip segment secured in the advance station, whereby the advance station insures that the strip segment in the separating station cannot be displaced.

From the constructive point of view, a particularly advantageous embodiment of the device is characterized in that the entrainment equipment has a counterplate supporting the foil strip and a frame overlapping across the counterplate. Together the frame and counterplate form a passage slot for the foil strip. Further, within the frame a slide is guided to move in parallel to the counterplate and in the longitudinal direction of the foil strip, the slide being movable back and forth in the guiding direction by means of a draw-actuation drive. At least one clamping shoe is provided, adjustable by means of a clamping actuator, which participates in the slide displacement and is positioned across through the passage slot against the counterplate. The clamping shoe has a friction lining facing the foil strip, and when pressed against the foil strip, it entrains same corresponding to the slide movements in a slippage-free friction contact.

Suitably, the clamping actuator consists of power cylinders, whose pistons are hydraulically or pneumatically actuatable against return springs.

As to the draw-actuation drive, there are several embodiment possibilities, according to the different ways of carrying out the method. If the strip segment is mainly to be stretched in one tug by a predetermined stroke length and then maintained in this stretched state without further changes, or the strip segment is to be stretched in action or only depending on force, an embodiment is recommended which is characterized in that for the draw actuator at least one pneumatic or hydraulic power cylinder is provided between the frame and the slide, which drives the slide against at least one return spring in the motion established from the separation station, by means of adjustable stroke and/or controllable force. For a timely variable, path-dependent control of the stretching process, it is however more appropriate to use a device wherein according to the invention, for the draw-actuation drive at the frame, there is arranged a motor with a cam plate driven by the motor shaft and at the slide, a rotatably supported cam roller running against the cam plate. Thereby the cam plate, in the time required for complete cooling of the strip segment to room temperature, performs a steering turn, in order to drive the slide against the force of the return springs in the motion established at the separating station. It is self-understood that within the framework of the invention it is possible to interchange the motor with the cam plate and the cam roller at the frame and the slide. In both cases, a force-dependence can be introduced also in the steering course in a very simple manner by interconnecting a spring member in the drive chain, between the cam roller and the slide. Through a suitable configuration of the cam disk and optionally through the rating of the spring member, the control of the stretching process can be optimally suited to any practical requirements.

BRIEF DESCRIPTION OF THE DRAWING

The invention will now be explained in more detail with the aid of an embodiment example, represented in the drawing, which shows.

DETAILED DESCRIPTION

Figure 1:
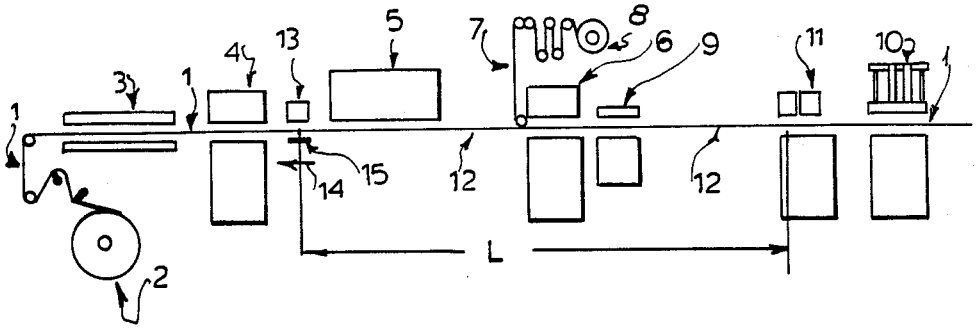
FIG. 1 a schematic representation of a packaging machine suited to carry out the method according to the invention, FIG. 2 a top view of an entrainment device used in a machine according to FIG. 1, for stretching the foil strip, in a top view vertical with respect to the plane of the foil strip, partially in section, FIG. 3 a section along the line III-III through the device of FIG. 2, FIG. 4 a section along the line IV-IV through the device of FIG. 2, FIG. 5 another embodiment of the entrainment device, a view similar to that of FIG. 2

In FIG. 1, a foil strip 1 starts from a supply roller 2 and runs first through a heating device 3, which heats the foil strip 1 up to the deep-drawing temperature. In a subsequent forming station 4, the packages are formed through the deep-drawing from the foil strip 1 in the respective shape needed or desired for packaging the product. For simplicity, the so-formed packages are not indicated in the foil strip 1 of FIG. 1. Thereafter, in a filling station 5, the packages are filled with the products to be packed, such as tablets, pills, or other small items. The filled packages are then sealed in a sealing station 6, wherefor a covering foil represented at 7 and supplied by a supply roller 8 is welded onto the foil strip 1. Immediately after the sealing station 6, the foil strip 1 and the covering foil 7 are cooled in a cooling station to a temperature which does not negatively influence the product. The filled and sealed packages are punched out from the foil strip 1 in a separating station marked 10, and this way are separated into individual packages. Foil strip 1 is transported in a timed manner, in this embodiment example, through the described work stations, starting with the heating station 3 up to the separating station 10, an advance station 11 provided in the embodiment example immediately before the separating station 10, considered in the direction of travel of the foil strip 1, serving for this purpose. All these described work stations 3, 4, 5, 6, 9, 10 and 11 and their effect upon the foil strip 1 are widely known to the state of the art and do not need any further description.

The foil strip 1 experiences a cooling between the sealing station 6 and the separating station 10, due to the cooling station 9. Besides this cooling of the foil strip 1 in the cooling station 9, the foil strip 1, during its travel between the forming station 4 and the separating station 10, loses heat also due to radiation and conductivity to the environment, and undergoes thereby an additional cooling, which all together lead to a shrinkage of the foil strip 1 on this segment of its travel between the forming station 4 and the separating station 10. The advance station 11 is so designed that at the pace at which the filled and sealed foil strip 1 is passed through the separating station 10, no displacement defects occur with respect to the sealing tool at the sealing station and with respect to the punching in the separation station. During a stoppage of the machine much more than when the machine is in operation, the foil strip 1 cools down everywhere from the forming station 4 to the separating station 10 and particularly along the strip segment 12 of length L. Under a sufficiently long standstill time T, e.g. of approximately 1 minute, cool down even reaches to room temperature. Under such circumstances the thereby caused longitudinal shrinking of the strip segment 12 would be greater than in the case of uninterrupted advance. With this increased shrinkage, the distance would decrease between the packages following each other in longitudinal direction of the foil strip relative to the distance formed before the machine standstill. When the machine is back in operation, the increased shrinkage in the strip segment 12 is not eliminated. As a result, the strip segment runs through the sealing station 6 with shorter intervals between the packages following each other. Evermore displacement defects from the sealing tool would ordinarily occur altering size from package to package. This displacement would continue until finally after the first package formed after restart in the forming station reaches the sealing station 6 and from the moment onward there would be reestablished the relations existing during the uninterrupted operation of the machine.

The packaging failures between the sealing tool and the packages, caused by such interruptions in machine operation in the sealing station, are eliminated through the present invention. With the onset of the transport interruption, the still warm strip segment 12, in any case with its already formed length L, is stretched to an increased length L' between the forming station 4 and the separating station 10. Length L' is maintained in a stretched state until the machine is restarted or the strip segment 12 has cooled down completely to room temperature, which takes in general about 1 minute. The elongation is thereby so dimensioned that the length difference L' - L at the end of the standstill time T or after complete cooling of the strip segment (cooling time T') is based only on elastic elongation. If after the time T or T', the strip segment 12 is released, so that it is free of longitudinal traction, it preserves an irreversibly stretched fraction arising from the elongation process. This fraction should be just as large as is needed to insure that the strip segment 12 has the same original length L in the cooler or completely cooled state as in the warm state. During the stretching process, the strip segment 12 is held in the advance station 11 to prevent longitudinal displacement with respect to the separating station 10. A clamping means which is an entrainment device 13 is provided for the stretching of the strip segment 12, at its other end at a point immediately after the forming station 4 in the direction of travel. Due to an actuation drive, the clamping means is movable back and forth once during one standstill period, with a motion stroke which can be adjusted in size or controlled in time, parallel to the direction of travel of the foil strip 1. The entrainment device is controlled so that its grasp of the foil strip 1 occurs only during the standstill time T or cooling time T' and entrains the foil free of slippage while the advance station 11 holds the strip segment 12 at its other end to prevent longitudinal displacement.

In detail, the entrainment device 13 comprises a counterplate 5 supported in the foil strip 1 and a frame 16, reaching across over the counterplate, and covered upwardly by a cover 17. Clamping pieces 18 grip the margin of the counterplate 15 on both sides. These clamping pieces are held on the frame 16 by fitting pins 19 and are lockable against the margin of the counterplate 15 by means of clamping screws 20. These screws engage with the pins 21 of the clamping pieces 18 in the corresponding blind holes of the counterplate 15. By actuation of the manual levers 23 provided for this purpose at the clamping screws 20, the frame 16 can both easily and swiftly be fastened or removed from the counterplate 15. Frame 16 forms with the counterplate 15 a passage slot 24 for the foil strip 1. Within the frame 16, a slide 25 is guided parallel to the counterplate 15 and in longitudinal direction with respect to the foil strip 1. Slide 25 runs with ball sleeves 26 on the guide bolt 27 fastened to the frame 16. The adjustment of the frame 16 in the direction of guidance takes place through the steerable draw actuator, which in the embodiment according to FIGS. 2 to 4 consists of two power cylinders 28, hydraulically or pneumatically actuatable, to which the pressure medium is applied through ducts not represented in the drawing via connections 29. The pistons 30 of these power cylinder 28 work against restoring springs mounted inside the power cylinders 28 and are therefore not represented in the drawing. The cylinder housings of these power cylinders 28 are connected via screws 31 with a bracket 32, which is held by screws 33 on the slide 25. The pistons 30 of the power cylinders 28 are connected to the frame 16 via screws 34. The stroke of the pistons 30, and thereby of the slide 25 is adjustable in its size, namely with the aid of adjusting screws 35, which are guided in the frame 16 and create a stop for the slide 25. Thereby the slide 25 under the action of the restoring springs, not represented in the drawing, lies against the adjusting screws 35, so that the pressure-medium actuated displacement of the slide 25 takes place in the direction of the arrow 14. This corresponds with the movement of the slide 25 in the direction of the forming station 4.

At the slide, two clamping shoes 36 are provided, which are actuatable through two clamping actuators transversely through the passage slot 24 against the counterplate 15, and which participate in the described displacement of the slide. These clamping actuators are also constructed as power cylinders 37, whose cylinder bodies are attached with screws 38 to the side of the slide facing the foil strip 1. Supply of the pressure medium takes place through the connections 39 recognizable in FIG. 4, with supply pipes again not shown in the drawing. The piston connections of these power cylinders 37, emerging from the cylinder bodies are marked with the numeral 40. Thereto, the clamping shoes 36 are mounted via screws 41. The clamping shoes 46 are positioned next to each other, considered in the direction of the width of the foil strip 1. Each shoe carries a frictional lining 42 facing the foil strip 1. The friction coefficient of this lining, with reference to the foil strip 1 and in comparison with the corresponding friction coefficient between the foil strip 1 and the counterplate 15, is sufficiently higher, so that the clamping shoes 36, when pressed with the frictional lining 42 against the foil strip 1 entrains the same in a slippage-free frictional connection correspondingly to the slide movements.

Also, the pistons 40 carrying the clamping shoes 36 are lifted off the guiding plate 15 and off the foil strip 1 resting thereon, against the action of restoring springs located within the power cylinders 37 (not discernible in the drawing), so that the pressing movement of the clamping shoes 36 against the foil strip 1 takes place due to the pressure medium supplied to the power cylinders 37 over the connections 39.

Figure 2:
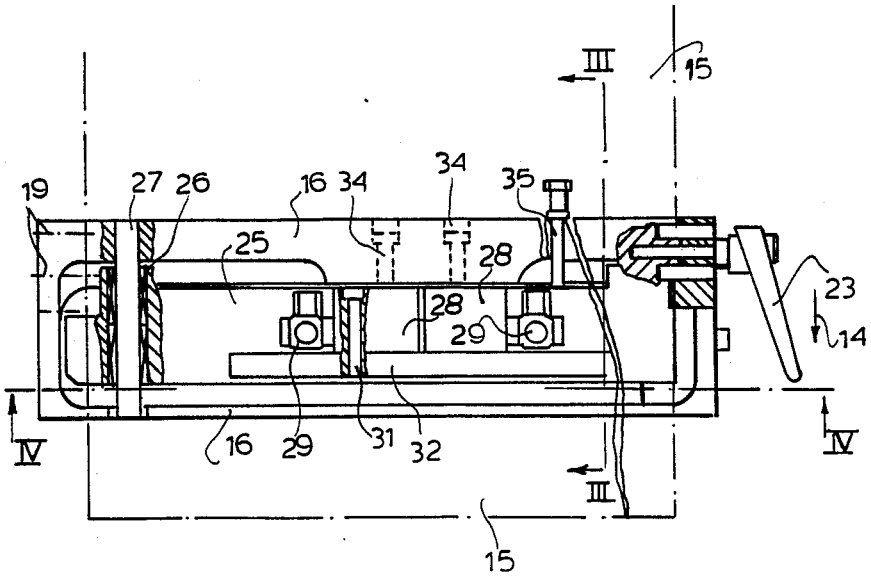
Figure 3:
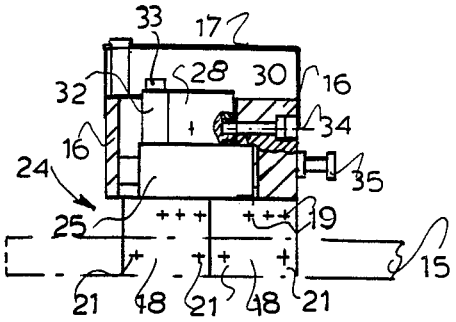
Figure 4:
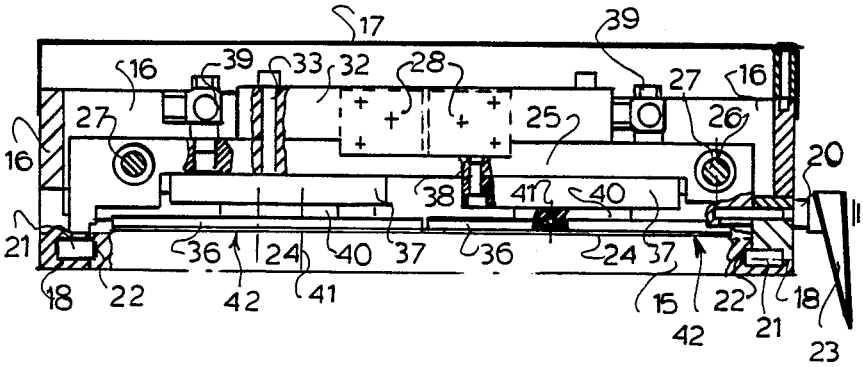

The mode of operation of this entrainment device 13 as shown in FIGS. 2 to 4 is such, that immediately after a stoppage of the foil-strip transport, the clamping shoes 36 are pressed against the foil strip 1, while the slide is still in its starting position, recognizable in FIGS. 2 to 4. The resultant slippage-free frictional connection between the clamping shoes 36 and the foil strip 1 causes the foil strip 1 to be entrained by the slide 25, precisely by its respective displacement stroke. This displacement stroke is so preadjusted in size, through the adjusting screws 35, that it creates an elongation of the strip segment 12 leading to a compensation of the otherwise length reduction, which takes place additionally in the strip segment 12 during a machine standstill. After the complete cooling of the strip segment 12 or at an earlier restart of the machine, the clamping shoes 36 are again lifted off the foil strip 1 and the slide 25 is moved back again in its starting position, whereby the strip segment 12 goes back to a state free of longitudinal tension, and has the original length L, as in the warm state at the beginning of the standstill. Over the size of the displacement force of the power cylinders 28, it is also possible to timely control the traction force which stretches the strip segment 12.

Figure 5:
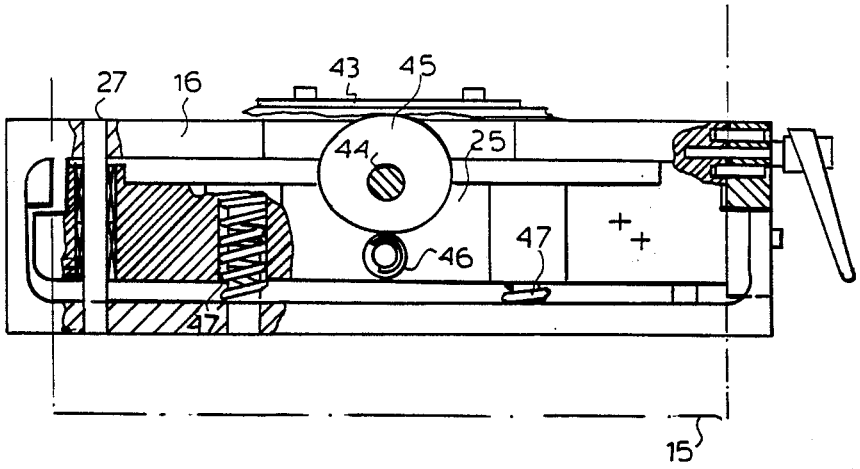
Figure 6:
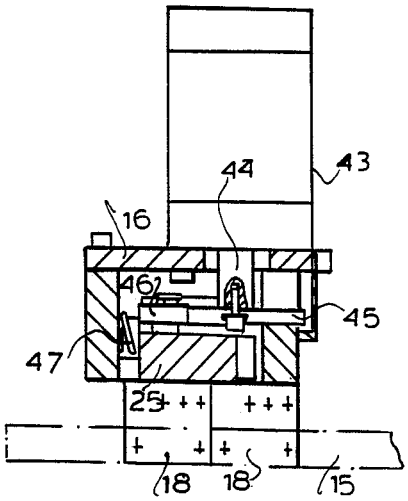
FIG. 6 the device of FIG. 5 in the representation according to FIG. 3, FIG. 7 the device of FIGS. 5 and 6 in the representation according to FIG. 4, and FIG. 8 a modified embodiment of the device in FIGS. 5 to 7, in a representation according to FIG. 5.

The embodiment example according to FIGS. 5 to 7 distinguishes itself from the one according to FIGS. 2 to 4 essentially in that for the stroke actuation, instead of the power cylinders 28, a motor 43 is arranged on the frame 16. A cam disk 45 is driven by shaft 44 of motor 43. On slide 25 is provided a rotatably supported cam roller 46 which rolls on the cam disk 45, while the former is driven by the motor 43 for a single steering rotation for each machine standstill. Corresponding to its respective shape of the cam, the cam disk 45 moves the slide 25 via the cam roller 46, against the force of the restoring springs 47 in the direction of the separating station 10, back and forth according to a certain travel-time function. This function determines the elongation process required to compensate the shrinkage of the strip segment and which can be optimally adjusted to all requirements of cases met in practice through the cam shape of the cam disk 45. In order to establish this cam shape, in practice it is enough to test with the machine in operational conditions, for a few values of the standstill time, the respective shrinkage behavior and the elongation size needed to compensate the same, and then to interpolate cam configuration at the cam disk between these few selected situations, which can be done altogether easily and without wasting time.

The embodiment example according to FIG. 8 differs from the one shown in FIGS. 5 to 7, essentially only in that the cam roller 46 is supported on a push rod 48, which at 50 is guidable longitudinally at the slide 25, against a spring member 49. Over this spring member 49, the controlling force on the slide 25, and therewith the traction force causing the elongation process in the strip segment 12, can be additionally influenced.

We claim:

1. A process for rectifying a length of a thermally shrinkable foil strip in a machine for producing and separating packages that successively includes a forming station, a further work station and a separating station, said length rectification comprising:

transporting a foil strip in a longitudinal direction of said machine, said transport including passing said foil strip through said forming, further work and separating stations;

heating said foil strip;

deep drawing said foil strip;

allowing said heated and deep drawn foil strip to cool and shrink while travelling between said forming and said separating stations;

upon an interruption of said transport, securing against displacement a strip segment of length L of said heated foil strip at one end thereof, said length L covering a distance from a point immediately downstream from said forming station in the travel direction to beyond said further work station but not greater than a point past said separating station;

stretching length L during said interruption via traction at an end of said foil opposite said one end to obtain a longer length L′, said stretching being maintained over a transport interruption time T but stretching for a shorter period where complete cooling of the strip segment occurs at cooling time T′ which is faster than T; and regulating stretching to achieve an elongation that is the difference between L and L′, that when no longer subjected to traction allows said foil to revert to its original length L, and that any modifications in package size and intervals between packages caused by the stretching are each no larger than a maximal tolerance permitted by a work process of a subsequent further work station.

2. Process according to claim 1 wherein the length difference L′ - L of the stretched strip segment is larger than any reduction due to shrinkage occurring in the strip segment in a state free of longitudinal traction during said time T and T′, and is basically maintained constant during said times.

3. Process according to claim 1 wherein the strip segment is secured against displacement at said one end situated between the further work station and the separating station and is subjected to a traction movement for its longitudinal stretching at said opposite end situated immediately after the forming station.

4. An apparatus for producing and separating packages having a device for rectifying length of a thermally shrinkable foil strip, said apparatus comprising:

a heating station;

a forming station downstream from said heating station in a longitudinal direction of travel of said foil;

a further work station downstream from said forming station, said further work station functioning to control tolerance ranges for parameters of the packages;

an advance station for transporting the foil strip along said longitudinal direction;

a separating station downstream from said advance station; and a clamping device arranged in the direction of travel of said foil downstream from said heating station and in a vicinity of said forming station, said device regulated to clamp said foil strip when a transport interruption occurs, the foil strip being secured at one end against longitudinal displacement during a transport interruption and the clamping device operates by entrainment being movable back- and forth by means of a draw-actuation drive to hold the foil strip without slippage during the interruption period but no longer than a time within which the foil is fully cooled, said clamping device including:

a counterplate supporting said foil strip;

a frame positioned over the counterplate;

a passage slot for the foil strip formed between said frame and counterplate;

a slide within said frame guidedly movable in a direction parallel to the counterplate and in the longitudinal direction of travel of said foil strip;

a draw-actuation drive for moving said slide back and forth in the guiding direction;

at least one clamping shoe positioned across the passage slot against the counterplate, said clamping shoe participating in moving said slide;

a clamping actuator for adjusting said clamping shoes; and a friction lining carried on said clamping shoe facing said foil strip, said friction lining being pressable against the foil strip to entrain the strip in a slippage-free frictional contact.

5. An apparatus according to claim 4 wherein the clamping actuator comprises power cylinders having pistons actuatable against restoring springs.

6. An apparatus according to claim 4 wherein the draw-actuation drive has at least one power cylinder provided between said frame and said slide, and which drives said slide against at least one restoring spring.

7. An apparatus according to claim 4 wherein the draw-actuation drive comprises a motor, a motor shaft driven by said motor, a cam plate driven by said motor shaft, and a rotatably supported cam roller rolling on said cam plate, and wherein during a time period T' sufficient to cool a foil strip segment between the advance station and clamping device to room temperature, said cam plate rotates and drives said slide against a force generated by restoring springs in a direction of the separating station.

8. An apparatus according to claim 7 wherein a spring member is interposed between the cam roller and the slide.

* * * * *

UNITED STATES PATENT AND TRADEMARK OFFICE

CERTIFICATE OF CORRECTION

PATENT NO. : 4,894,977

DATED : 23 January 1990

INVENTOR(S) : Herbert RITTINGER et al.

It is certified that error appears in the above-identified patent and that said Letters Patent is hereby corrected as shown below:

In the Heading:

Item [30] - Foreign Application Priority Data - should read:

--Jan. 29, 1986 [DE] Fed.Rep. of Germany ... 3602604--.

Signed and Sealed this

Nineteenth Day of February, 1991

*Attest:*

HARRY F. MANBECK, JR.

*Attesting Officer*

*Commissioner of Patents and Trademarks*